US006385576B2

(12) United States Patent
Amada et al.

(10) Patent No.: US 6,385,576 B2
(45) **Date of Patent: *May 7, 2002**

(54) SPEECH ENCODING/DECODING METHOD USING REDUCED SUBFRAME PULSE POSITIONS HAVING DENSITY RELATED TO PITCH

(75) Inventors: Tadashi Amada; Kimio Miseki, both of Kobe (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/220,062

(22) Filed: Dec. 23, 1998

(30) Foreign Application Priority Data

Dec. 24, 1997 (JP) ..... 9-355748

(51) Int. Cl.[7] ..... G10L 19/08
(52) U.S. Cl. ..... 704/223; 704/219
(58) Field of Search ..... 704/219, 222, 704/223

(56) References Cited

U.S. PATENT DOCUMENTS

| | | | | | |
|---|---|---|---|---|---|
| 4,731,846 | A | | 3/1988 | Secrest et al. | |
| 5,602,961 | A | * | 2/1997 | Kolesnik et al. | 704/223 |
| 5,699,482 | A | * | 12/1997 | Adoul et al. | 704/219 |
| 5,701,392 | A | * | 12/1997 | Adoul et al. | 704/219 |
| 5,717,824 | A | * | 2/1998 | Chhatwal | 704/222 |
| 5,727,122 | A | * | 3/1998 | Hosoda et al. | 704/223 |
| 5,752,223 | A | * | 5/1998 | Aoyagi et al. | 704/219 |
| 5,754,976 | A | * | 5/1998 | Adoul et al. | 704/223 |
| 5,864,797 | A | * | 1/1999 | Fujimoto | 704/223 |

FOREIGN PATENT DOCUMENTS

| | | |
|---|---|---|
| EP | 0 411 655 | 2/1991 |
| EP | 0 778 561 | 6/1997 |
| JP | 8-123494 | 5/1996 |
| JP | 10-92794 | 4/1998 |
| WO | WO 88/02165 | 3/1988 |

OTHER PUBLICATIONS

J.P. Adoul, et al., IEEE International Conference on Aoustics, Speech & Signal Processing, ICASSP '87, vol. 4, pps. 1957–1960, "Fast CELP Coding Based on Algebraic Codes," Apr. 6–9, 1987.

T. Amada, et al., IEEE International Conference on Acoustics, Speech, and Signal Processing, ICASSP, '99, vol. 1, pps. 13–16, "CELP Speech Coding Based on an Adaptive Pulse Position Codebook," Mar. 15–19, 1999.

* cited by examiner

*Primary Examiner*—Tālivaldis Ivars Šmits
(74) *Attorney, Agent, or Firm*—Oblon, Spivak, McClelland, Maier & Neustadt, P.C.

(57) ABSTRACT

A speech encoding method in which information representing characteristics of a synthesis filter is generated based on an input speech signal in units of one frame. A pitch vector is generated from an adaptive codebook containing past excitation signals, and a first number of reduced pulse position candidates are generated by selecting a first number of pulse positions from a number of possible pulse positions in each of sub-frames obtained by dividing the frame, where a density of the reduced pulse position candidates is high where the pitch vector has a large power and decreases in accordance with a decrease in the power. A second number of pulse positions is selected from the reduced pulse position candidates to generate a pulse train having a plurality of pulses located at pulse positions corresponding to a second number of pulse positions under the criterion of minimizing an error between the input speech signal and a synthesis signal which is an output of the synthesis filter whose input is an excitation signal generated by adding the pitch vector and the pulse train.

20 Claims, 14 Drawing Sheets

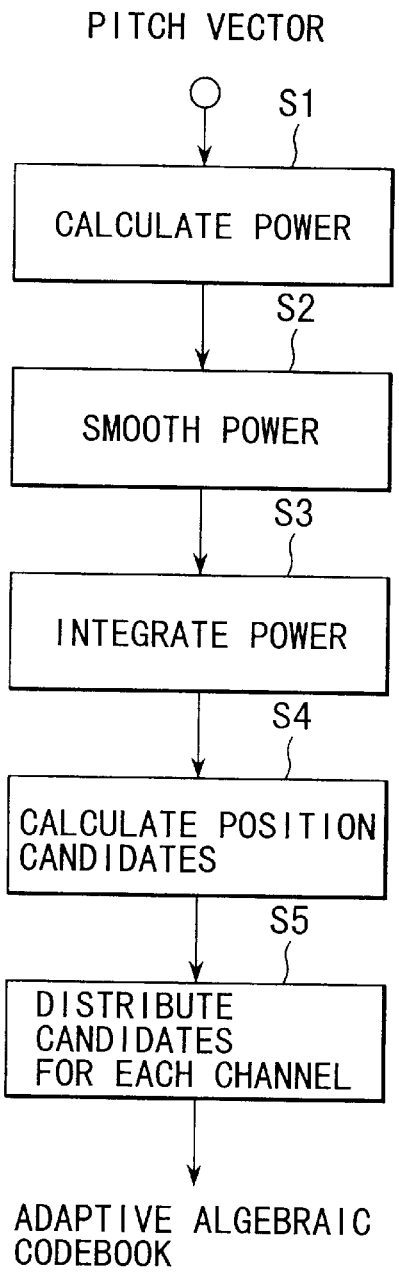
FIG. 2
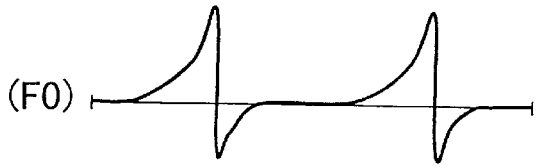
FIG. 3A
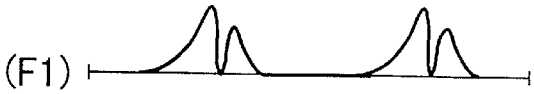
FIG. 3B
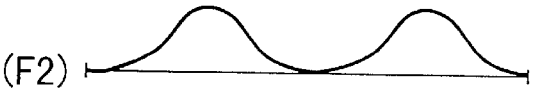
FIG. 3C
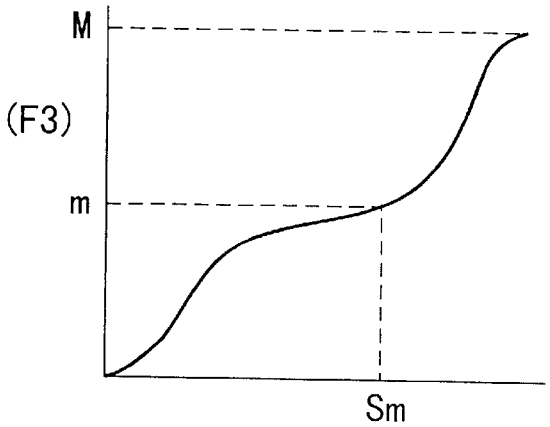
FIG. 3D
$$
\begin{aligned}
ch1 &= \{S1, S4, \cdots S_{M-2}\} \\
ch2 &= \{S2, S5, \cdots S_{M-1}\} \\
ch3 &= \{S3, S6, \cdots S_{M}\}
\end{aligned}
$$
FIG. 3E

SPEECH ENCODING/DECODING METHOD USING REDUCED SUBFRAME PULSE POSITIONS HAVING DENSITY RELATED TO PITCH

BACKGROUND OF THE INVENTION

The present invention relates to an encoding/decoding method of a low bit rate used for digital telephone, voice memo, etc.

In recent years, the encoding techniques have found wide applications in the portable telephone or the internet in which the speech and music sound are transmitted and stored by being compressed at a low bit rate. Such techniques include the CELP method (Code Excited Linear Prediction (M. R. Schroeder and B. S. at al), "Code Excited Linear Prediction (CELP): High Quality Speech at Very Low Bit Rates", Proc. ICASSP, pp.937–940, 1985 (reference 1) and W. S. Kleijin, D. J. Krasinski et al. "Improved Speech Quality and Efficient Vector Quantization in SELP", Proc. ICASSP, pp.155–158, 1988 (reference 2)).

The CELP is an encoding scheme based on the linear predictive analysis. An input speech signal is divided into a linear prediction coefficient representing the phoneme information and a prediction residual signal representing the sound level, etc. according to the linear predictive analysis. Based on the linear predictive coefficients, a recursive digital filter called a synthesis filter is configured, and supplied with a prediction residual signal as an excitation signal thereby to restore the original input speech signal.

For encoding at low bit rate, it is necessary to encode, with as low bit rates as possible, the linear predictive coefficients constituting the synthesis filter information representing the characteristics of the synthesis filter and the prediction residual signal constituting the characteristic of the synthetic filter. In the CELP scheme, two types of signal including the pitch vector and the noise vector are each multiplied by an appropriate gain and added to each other thereby to generate an excitation signal in the form encoded from the prediction residual signal. A method of generating the pitch vector is described in detail in reference 2 for example. There is proposed a method of using a fixed coded vector on a rising portion (onset portion) of a speech other than the method of the reference 2. However, in the present invention, such vectors are used as pitch vectors.

The noise vector is normally generated by storing a multiplicity of candidates in a stochastic codebook and selecting an optimum one. In a method of searching for a noise vector, all the noise vectors are added to the pitch vector and then a synthesis speech signal is generated through a synthetic filter. The error of this synthesis speech signal with respect to the input signal is evaluated thereby to select a noise vector generating a synthesis speech signal with the smallest error. What is most important for the CELP scheme, therefore, is how efficiently to store the noise vectors in the stochastic codebook.

The algebraic codebook (J-P. Adoul et al, "Fast CELP Coding based on algebraic codes", Proc. ICASSP '87, pp.1957–1960 (reference 3)) has a simple structure in which the noise vector is indicated only by the presence or absence of a pulse and the sign (+, −) thereof. The algebraic codebook, as compared with the stochastic codebook with a plurality of noise vectors stored therein, need not store any code vector and has the feature of a very small calculation amount. Also, the sound quality of the system using the algebraic codebook is not inferior to that of the prior art, and therefore has recently been used for various standard schemes.

In the algebraic codebook, however, the deterioration of the sound quality becomes more conspicuous with the decrease in the encoding bit rate. One reason is the shortage of the pulse position information. Specifically, in view of the fact that the algebraic codebook algebraically simplifies the positional information of the pulse, in spite of the advantage described above, position candidates sometimes exist at points where a pulse rise is not required for low bit rate encoding but not at required points. This not only deteriorates the efficiency but also deteriorates the sound quality.

Another reason for the deterioration of the sound quality when using the algebraic codebook is the shortage of the number of pulses. The shortage of pulses gives rise to a pulse-like noise in the decoded speech. This is because an excitation signal is generated from a pulse train and the presence or absence of a pulse can be easily acknowledged perceptually with the decrease in the number of pulses. For improving the sound quality, it is necessary to alleviate the pulse-like noise.

As described above, the conventional algebraic codebook has the advantage of a simple structure and a small amount of calculation, but poses the problem that the quality of the decoded speech is deteriorated due to the shortage of the pulses-and the positional information of the pulse train making up the excitation signal for the synthesis filter at a low bit rate.

BRIEF SUMMARY OF THE INVENTION

The object of the present invention is to provide a speech encoding/decoding method which can secure a superior sound quality even at a low bit rate encoding.

According to a first aspect of the invention, there is provided a speech encoding method comprising the steps of generating at least information representing the characteristics of a synthesis filter for a speech signal, and generating an excitation signal for exciting the synthesis filter, including a pulse train generated by setting pulses at a predetermined number of pulse positions selected from the pulse position candidates adaptively changed in accordance with the characteristics of the speech signal.

According to another aspect of the invention, there is provided a speech decoding method for inputting an excitation signal to a synthesis filter and decoding a speech signal, the excitation signal containing a pulse train generated by setting pulses at a predetermined number of pulse positions selected from the pulse position candidates adaptively changed in accordance with the characteristics of the speech signal.

In a speech encoding/decoding method according to this invention, the excitation signal for exciting the synthesis filter contains a pulse train generated by setting pulses at a predetermined number of pulse positions selected from the pulse position candidates adaptively changed in accordance with the characteristics of the speech signal. More specifically, the pulse position candidates are assigned in such a manner that more candidates exist at a domain of larger power of the speech signal.

Also, the excitation signal can be configured to include a pulse train generated by setting pulses at all the pulse position candidates adaptively changing in accordance with the characteristics of the voice signal and optimizing the amplitude of each pulse with predetermined means. In such a case, more specifically, the pulse position candidates are assigned so that more candidates exist at a domain of larger power of the voice signal.

Alternatively, the excitation signal can be generated by use of a pulse train generated by setting pulses at a predetermined number of pulse positions selected from first pulse position candidates changing adaptively in accordance with the characteristics of the voice signal or a pulse train generated by setting pulses at a predetermined number of pulse positions selected from second pulse position candidates including a part or the whole of the positions not used as the first pulse position candidates. In this case, the first pulse position candidates are arranged, more specifically, so that more candidates exist at a domain that the power of the speech signal is larger.

Also, in the case where the excitation signal includes a pitch vector and a noise vector, the noise vector is generated by setting pulses at a predetermined number of pulse positions selected from the pulse position candidates changed in accordance with the shape of the pitch vector. More specifically, more pulse position candidates are located at a domain of larger power of the pitch vector.

Also, the noise vector can be configured by use of a pulse train generated by setting pulses at a predetermined number of pulse positions selected from position candidates set based on the position candidate density function determined from the shape of the pitch vector. In such a case, the pulse position candidates are, more specifically, arranged in such a manner that more candidates exist at a place where the value of the position candidate density function is larger. The position candidate density function is a function describing the relationship between the probability of arranging the pulses and the power of the pitch vector.

Further, in the case of using a compensation filter such as a pitch period emphasis filter, a modified pitch vector is generated from the pitch vector applied through a filter based on this inverse characteristic, and the noise vector is generated by setting pulses at a predetermined number of pulse positions selected from the pulse position candidates changing in accordance with the shape of the inverse correction pitch vector. In such a case, the pulse position candidates are, more specifically, arranged in such a manner that more candidates exist at a domain that the power of the inverse correction vector is larger.

By adaptively changing the pulse position candidates in accordance with the characteristics such as the power distribution of the speech signal as described above, the encoding efficiency is improved even when using an algebraic codebook in which the pulse positions and the number of pulses are reduced due to the low bit rate. Thus, the bit rate can be reduced while maintaining the quality of the decoded speech. Also, since the pitch vector is used for producing pulse position candidates, the adaptation of the pulse position candidates becomes possible without any additional information.

In another speech encoding/decoding method according to this invention, an excitation signal including a pitch vector and a noise vector contains a pulse train shaped by a pulse shaping filter having the characteristics determined based on the shape of the pitch vector.

With this configuration, the pulse-like noise contained in the decoded speech due to the reduced number of pulses is alleviated, and even in the case where the pulse positions or the number of pulses is reduced due to the low bit rate, the bit rate can be reduced while maintaining the quality of the decoded speech.

Further, in a speech encoding/decoding method according to this invention, an excitation signal is generated, including a pulse train generated by setting pulses at a predetermined number of pulse positions selected from the pulse position candidates adaptively changed in accordance with the characteristics of the speech signal. Also, the pulse train can be shaped by a pulse shaping filter having a characteristic determined based on the shape of the pitch vector.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 2 is a flowchart showing the steps of selecting pulse position candidates according to the first embodiment of the invention;

FIGS. 3A, 3B, 3C, 3D, and 3E are diagrams showing the manner of processing at each step in FIG. 2;

DETAILED DESCRIPTION OF THE INVENTION

Figure 1:
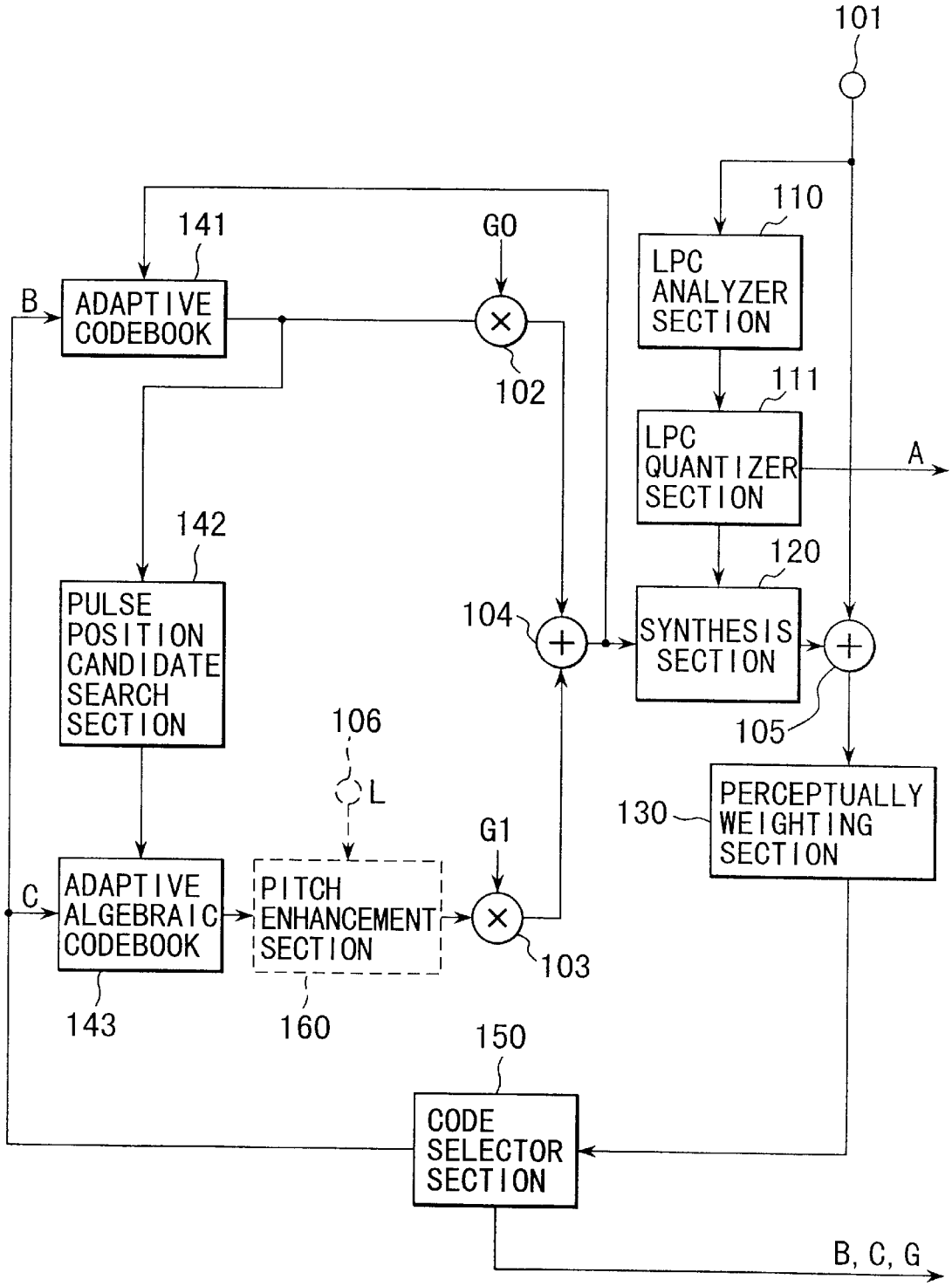
FIG. 1 is a block diagram showing a speech encoding system according to a first embodiment of the present invention.

FIG. 1 shows a speech encoding system using a speech encoding method according to a first embodiment. This speech encoding system comprises input terminals 101, 106, an LPC analyzer section 110, an LPC quantizer section 111, a synthesis section 120, a perceptually weighting section 130, an adaptive codebook 141, a pulse position candidate search section 142, an adaptive algebraic codebook 143, a code selector section 150, a pitch enhancement section 160, gain multiplier sections 102, 103 and adder sections 104, 105.

The input terminal 101 is supplied with an input speech signal to be encoded, in units of one-frame length, and in synchronism with this input, a linear prediction analysis is conducted whereby a linear prediction coefficient (LPC) corresponding to the vocal track characteristic is determined. The LPC is quantized by the LPC quantizer section 111, and the quantization value is input to the synthesis section 120 as synthesis section information indicating the characteristic of the synthesis section 120. The synthesis section 120 usually consists of a synthesis filter. An index A indicating the quantization value is output as the result of encoding to a multiplexer section not shown.

The adaptive codebook 141 has stored therein the excitation signals input in the past to the synthesis section 120. The excitation signal constituting an input to the synthesis section 120 is a prediction residual signal quantized in the linear prediction analysis and corresponds to the glotall source containing the information on the sound level or the like. The adaptive codebook 141 cuts out the waveform in the length corresponding to the pitch period from the past excitation signal and by repeating this process, generates a pitch vector. The pitch vector is normally determined in units of several subframes into which a frame is divided.

The pulse position candidate search section 142 determines by calculation the positions at which pulse position candidates are set in the subframe based on the pitch vector determined by the adaptive codebook 141 and outputs the result of the calculation to the adaptive algebraic codebook 143.

The adaptive algebraic codebook 143 searches the pulse position candidates input from the pulse position candidate search section 142 for a predetermined number of pulse positions and the signs (+ or −) thereof in such a manner that the distortion against the input speech signal excluding the effect of the pitch vector is minimized under the perceptual weight.

The pulse train output from the adaptive algebraic codebook 143 is given a periodicity in units of pitches by the pitch enhancement section 160 as required. The pitch enhancement section 160 usually consists of a pitch filter. The pitch enhancement section 160 is supplied with the information L on the pitch period determined by the search of the adaptive codebook 143 from the input terminal 106 and thus the pulse train is given a periodicity of the pitch period.

The pitch vector output from the adaptive codebook 141 and the pulse train output from the adaptive algebraic codebook 143 and given a periodicity by the pitch enhancement section 160 as required are multiplied by the gain GO for the pitch vector and the gain G1 for the noise vector at the gain multiplier sections 102, 103, respectively,,added to each other at the adder section 104, and applied to the synthesis section 120 as an excitation signal. The optimum gains GO, G1 are selected from the gain codebook (not shown) which normally stores a plurality of gains.

The code selector section 150 outputs an index B indicating the pitch vector selected by the search of the adaptive codebook 141, an index C indicating the pulse train selected by the search of the adaptive algebraic codebook 143, and an index G indicating the gains GO, G1 selected by the search of the gain codebook. These indexes B, C, G and the index A indicating the synthesis filter information constituting the quantization value of the LPC from the LPC quantizer section 111 are multiplexed in a multiplexer section not shown and transmitted as an encoded stream.

Now, an explanation will be given of the pulse position candidate search section 142 and the adaptive algebraic codebook 143 constituting the features of the present embodiment.

According to this embodiment, the fact that the pulses tend to be set mainly around the sections where the power of excitation signal is large is utilized to permit only the bit rate to decrease without deteriorating the sound quality. Thus, pulse position candidates are set for each subframe in such a manner as to assign more position candidates for sections where the power of the excitation signal is larger.

The pitch vector resembles the shape of an ideal excitation signal. It is therefore effective to set pulse position candidates by the pulse position candidate search section 142 based on the pitch vector determined by the search of the adaptive codebook 141. The same pitch vector can be obtained on the decoding side as on the encoding side, and therefore it is not necessary to generate additional information for the adaptation of pulse position candidates.

In the case where pulse position candidates are assigned only at points of large power for the adaptation of the pulse position candidates, the sound quality may be deteriorated due to the continuous lack of the position candidates in a section of small power. Various methods of adaptation of pulse position candidates are conceivable. The methods described below, for example, make possible the adaptation with a small deterioration of the sound quality.

With reference to the flowchart of FIG. 2, an explanation will be given of the steps of-adaptation of pulse position candidates by the pulse position candidate search section 142. FIGS. 3A to 3D show an input pitch vector waveform (F0), power (F1) of this input pitch vector waveform, smoothed power (F2) and an integrated value (F3) in sample direction of the smoothed power, each corresponding to the steps of FIG. 2.

A similar processing is possible by use of other measures indicating the waveform such as an absolute value (square root of the power) of the amplitude value other than the power. In this embodiment, these measures are collectively defined as the power.

First, the power (F1) of FIG. 3B is calculated for the input pitch vector (F0) of FIG. 3A (step S1), and then the power (F1) is smoothed as shown in FIG. 3C thereby to produce the smoothed power (F2) (step S2). The power can be smoothed, for example, by a method of weighting with a window of several samples and taking a moving average.

Next, the power smoothed in step S2 is integrated for each sample (step S3). The manner of this operation is shown in FIG. 3D. Specifically, let p(n) be the smoothed power of the n-th sample, q(n) be the integrated value of the smoothed power p(n) and L be the subframe length. The integrated value q(n) is determined as $$q(n)=p(n)+q(n-1)+C(n=0, \ldots, L-1)$$

where C is a constant for adjusting the degree of the density of pulse position candidates.

Pulse position candidates are calculated using this integrated value q(n) (step S4). In this case, the integrated value is normalized so that the number of position candidates determined by the integrated value for the last sample is M. The position of the m-th candidate can be determined as Sm in correspondence with the integrated value as shown in FIG. 3D. Position candidates in the number of M can be determined by repeating this process for m of 0 to M−1.

Figure 4:
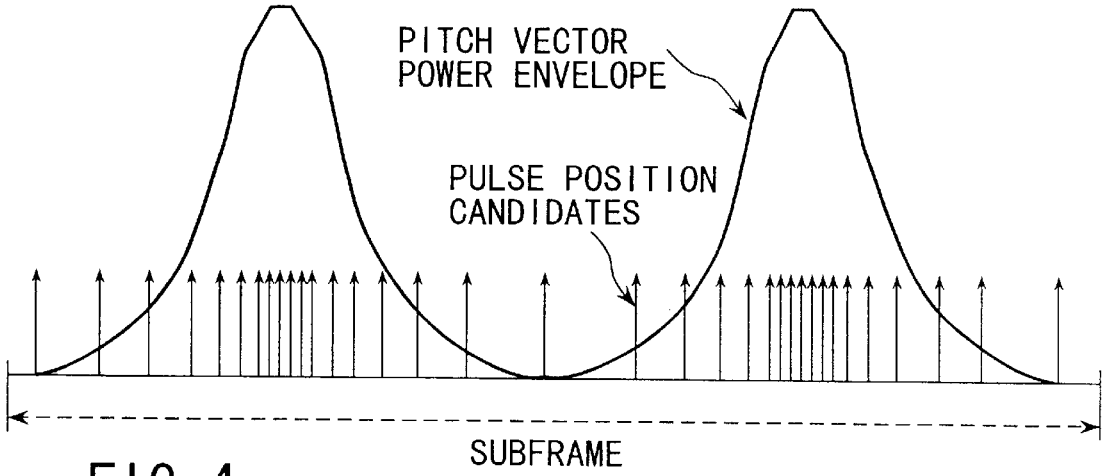
FIG. 4 is a diagram showing the relation between the power envelope of the pitch vector and the pulse position candidates according to the first embodiment.

FIG. 4 shows the relation between the pulse candidate positions determined as described above and the power of the pitch vector. The solid curve represents the power envelope of the pitch vector, and the arrows pulse position candidates. As shown in this diagram, the pulse position candidates are distributed densely where the pitch vector has a large power and progressively become coarse according as the power decreases. As a result, pulse positions can be selected more accurately where the power of the pitch vector is large. Also, even in the case where the number of pulse position candidates decreases due to the low bit rate, the encoding of high sound quality is possible by concentrating a few number of pulse position candidates adaptively at points of large power.

Next, the position candidates thus determined are distributed among channels (step S5). Among various methods of distribution available, the one shown in FIG. 3E is desirable in which the position candidates are distributed in staggered fashion among the channels.

In this way, the adaptive algebraic codebook 143 is determined. In the search process, the optimum position and the sign of a pulse is selected from each of the channels (Ch1, Ch2, Ch3) in the adaptive algebraic codebook 143, thereby generating a noise vector made up of three pulses.

In the case where the subframe length is 80 samples, for example, substantially no perceptual deterioration is felt when the above-mentioned method is used even if the pulse position candidates are reduced to about 40 samples.

In the algebraic codebook, the pulse amplitude is normally either +1 or −1. Nevertheless, a method has been proposed which uses a pulse having amplitude information. For example, reference 4 (Chang Deyuan, "An 8 kb/s low complexity ACELP speech codec," 1996 3rd International Conference on Signal Processing, pp. 671–4, 1996) discloses a method in which the pulse amplitude is selected from 1.0, 0.5, 0, −0.5 and −1.0. Also, a multi-pulse scheme providing a kind of pulse excitation signal configured of a pulse train having an amplitude is described in reference 5 (K. Ozawa and T. Araseki, "Low Bit Rate Multi-pulse Speech Coder with Natural Speech Quality," IEEE Proc. ICASSP '86, pp.457–460, 1986). The present invention is also applicable to the case represented by the above-mentioned examples in which the pulse has an amplitude.

Figure 5:
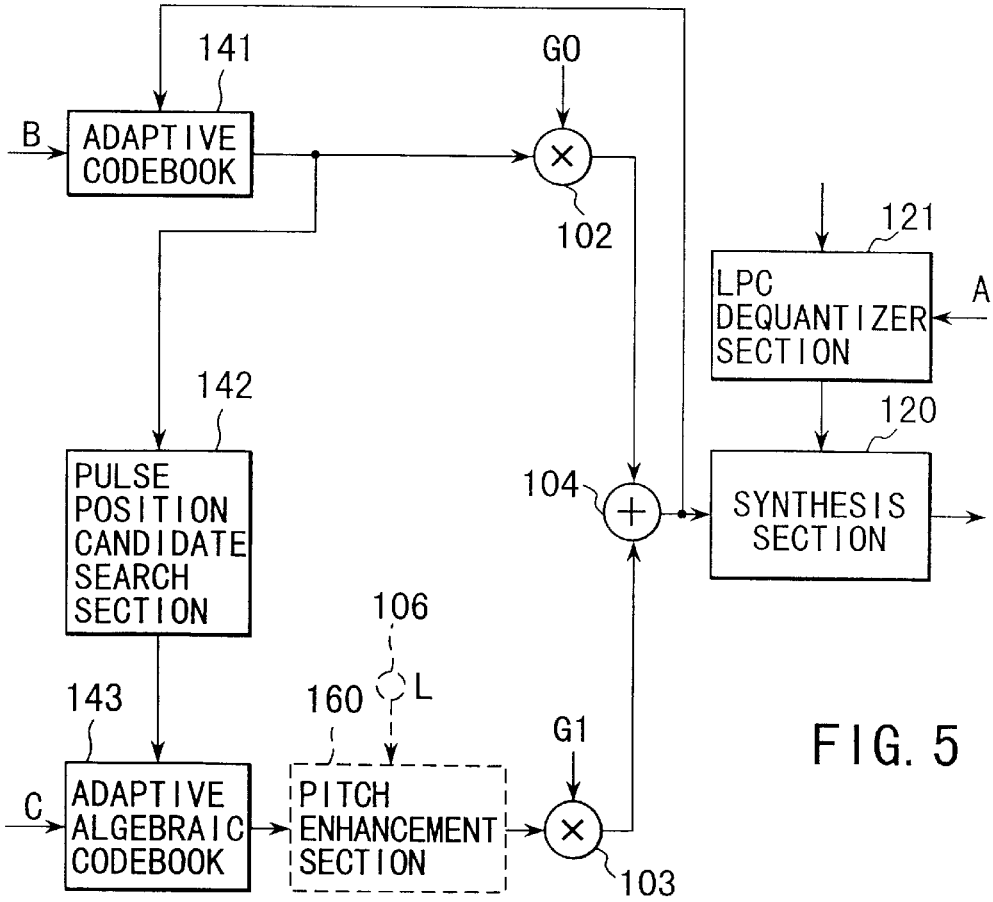
FIG. 5 is a block diagram showing a speech decoding system according to the first embodiment.

Now, a speech decoding system corresponding to the speech encoding system of FIG. 1 will be explained with reference to FIG. 5.

The same component parts having the same function as the corresponding ones in FIG. 1 will be designated by the same reference numerals, respectively. The speech decoding system of FIG. 5 comprises a synthesis section 120, a LPC dequantizer section 121, an adaptive codebook 141, a pulse position candidate search section 142, an adaptive algebraic codebook 143, a pitch enhancement section 160, gain multiplier sections 102, 103 and an adder section 104. The speech decoding system is supplied with an encoded stream transmitted from the speech encoding system of FIG. 1.

The encoded stream thus input is applied to a demultiplexer section 121 not shown, and output after being demultiplexed by the demultiplexer section 121 into the index A of the synthesis filter information described above, the index B indicating the pitch vector selected by the search of the adaptive codebook 141, the index C indicating the pulse train selected by the search of the adaptive algebraic codebook 143, the index G indicating the gains G0, G1 selected by the search of the gain codebook, and the index L indicating the pitch period.

The index A is decoded by the LPC dequantizer section 121 thereby to determine the LPC constituting the synthesis filter information, which is input to the synthesis section 120. The indexes B and C are input to the adaptive codebook 141 and the adaptive algebraic codebook 143, respectively. The pitch vector and the pulse train are output from these codebooks 141, 143, respectively. In this case, the adaptive algebraic codebook 143 outputs a pulse train by determining the pulse positions and the signs from the index B and the adaptive algebraic codebook 143 formed by the pulse position candidate search section 142 based on the pitch vector input from the adaptive codebook 141. The pulse train output from the adaptive algebraic codebook 143 is given a periodicity of the pitch period L by the pitch enhancement section 160 as required.

The pitch vector output from the adaptive codebook 141 and the pulse train output from the adaptive algebraic codebook 143 and given a periodicity by the pitch enhancement section 160 as required are multiplied by the gain G0 for the pitch vector and the gain G1 for the noise vector at the gain multiplier sections 102, 103, respectively, after which they are added to each other at the adder section 104 and applied to the synthesis section 120 as an excitation signal. A reconstructed speech signal is output from this synthesis section 120. The gains G0, G1 are selected from a gain codebook not shown according to the index G.

As described above, according to this embodiment, only the bit rate can be reduced while maintaining the high speech quality. So, the speech encoding/decoding of high quality can be realized with low bit rate.

Figure 6:
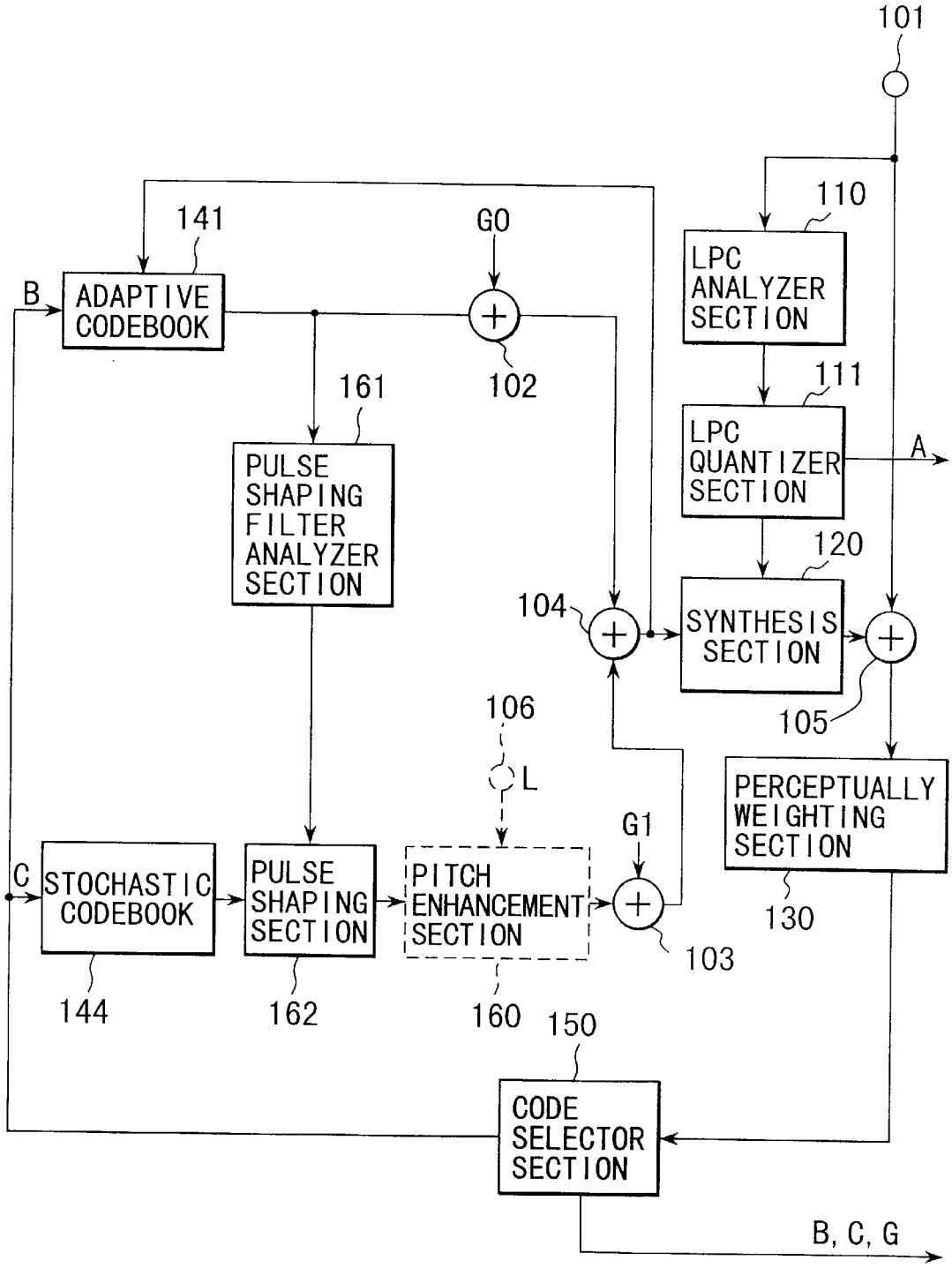
FIG. 6 is a block diagram showing a speech encoding system according to a second embodiment of the invention.

FIG. 6 shows a speech encoding system according to a second embodiment of the invention. This speech encoding system has a configuration similar to the configuration of the first embodiment shown in FIG. 1, except that in the present embodiment, the pulse position candidate search section 142 and the adaptive algebraic codebook 143 are not included, and the adaptive algebraic codebook 143 is replaced by an ordinary stochastic codebook 144 and further a pulse shaping filter analyzer section 161 and a pulse shaping section 162 are added thereto.

Now, the steps of processing according to this embodiment will be explained. The input speech signal is subjected to the LPC analysis and LPC quantization, followed by the search of the adaptive codebook 141 in the same steps as in the first embodiment. The stochastic codebook 144 is configured of an algebraic codebook, for example, in this embodiment.

The pulse shaping filter analyzer section 161 determines and outputs the parameter of the pulse shaping section 162 which normally consists of a digital filter, based on the pitch vector determined by searching the adaptive codebook 141. The pulse shaping section 162 filters the output of the stochastic codebook 144 and outputs a shaped noise vector.

As in the first embodiment, the noise vector is given a periodicity using the pitch enhancement section 160 as required. The gains G0, G1 for the pitch vector and the noise vector are determined and an index is output. The parameters of the pulse shaping section 162 are determined from the pitch vector, and therefore the addition of new information is not required.

The feature of this embodiment resides in that the pulse shaping section 162 is set based on the waveform of the pitch vector thereby to shape the pulse train output from the stochastic codebook 144 including an algebraic codebook. As described with reference to the first embodiment, the low rate encoding reduces the number of pulse positions and pulses and thus deteriorates the sound quality conspicuously. A reduced number of pulses causes a conspicuous pulse-like noise in the decoded speech. The use of the pulse shaping section 162 as in the present embodiment, however, remarkably alleviates the pulse-like noise.

Various methods are available for designing the pulse shaping section 162. A first example is to utilize the phenomenon that the excitation signal for exciting the synthesis filter, if phase-equalized, becomes a pulse-like signal. In the case where a phase equalization inverse filter is used, therefore, a waveform similar to the ideal excitation signal is produced from a pulse-like signal input. The disadvantage of the conventional method of using a pulse waveform lies in that the phase information otherwise contained in the ideal excitation signal is lacking. The decreased number of pulses makes this problem conspicuous. In view of this, as in this example, the phase information is added to the pulse shaping section 162, thereby making it possible to generate a waveform similar to the ideal excitation signal from a pulse waveform.

In this first example, the information on the filter coefficient of the phase equalization inverse filter is required to be transmitted, and the bit rate is increased correspondingly. Thus, a second example method conceivable is to employ a pulse shaping section 162 using a pitch vector as an approximation of the phase information. In a voiced section or the like, the pitch vector is similar in shape to the excitation signal and therefore the phase information can be extracted.

As a specific example method, a pulse shaping filter can be used, in which synchronized points such as peak points of the pitch vector are determined and a waveform of several samples is extracted from the particular synchronized point as an impulse response of the pulse shaping filter. The effective length of the waveform thus extracted is about 2 to 3 samples. It is also effective to "window" and thereby attenuate the extracted samples before use. Another advantage is that since the same pitch vector is produced on both the decoding and encoding sides, a new transmission bit is not required. At the time of searching the stochastic codebook 144, the pulse shaping section 162 remains in constant operation. By calculating the impulse response together with that of the synthesis section 120 in advance, therefore, the calculation amount can be reduced.

Figure 7:
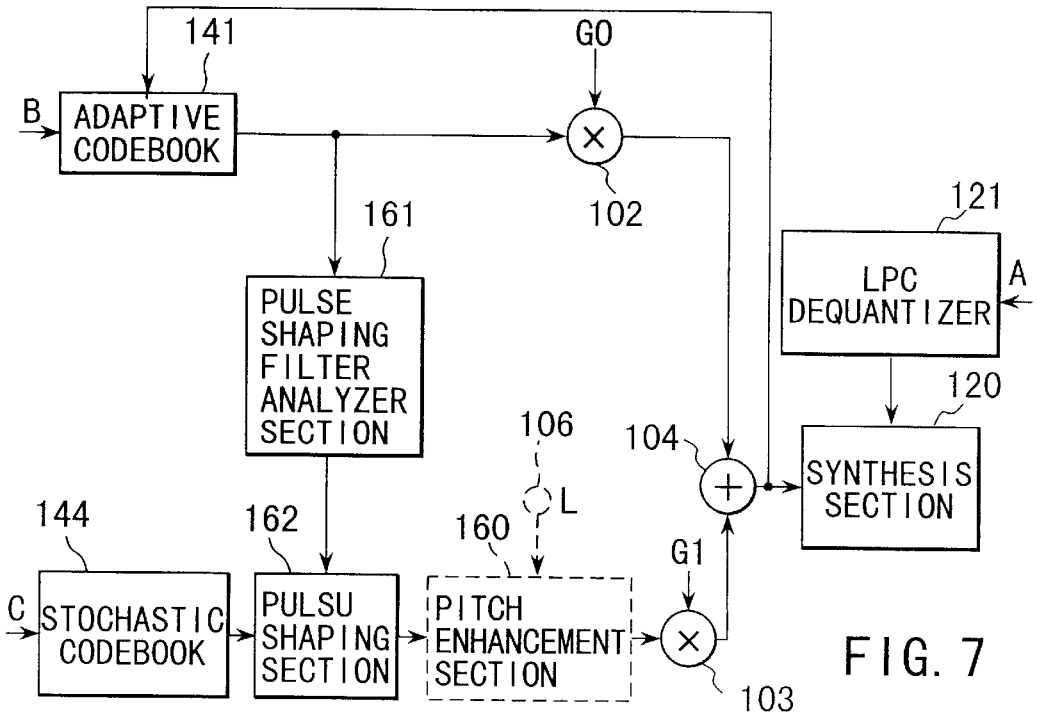
FIG. 7 is a block diagram showing a speech decoding system according to the second embodiment.

FIG. 7 shows a speech decoding system corresponding to the speech encoding system of FIG. 6. The component parts having the same functions as the corresponding component parts in FIG. 6 are designated by the same reference numerals, respectively. The speech decoding system of FIG. 7 includes the synthesis section 120, a LPC dequantizer section 121, an adaptive codebook 141, a stochastic codebook 144, a pulse shaping filter analyzer section 161, a pulse shaping section 162, a pitch enhancement section 160, gain multiplier sections 102, 103 and an adder section 104. This system is supplied with an encoded stream transmitted from the speech encoding-system of FIG. 6.

The encoded stream is input to a demultiplexer section not shown, which produces an output in divided forms including an index A of the synthesis filter information described above, an index B indicating the pitch vector selected by the search of the adaptive codebook 141, an index C indicating the pulse train selected by the search of the stochastic codebook 144, and an index G indicating the gains G0, G1 selected by the search of the gain codebook. The pitch period L is calculated by the index B.

The index A is decoded by the LPC dequantizer section 121 into the synthesis filter information and input to the synthesis section 120. The indexes B and C are input to the adaptive codebook 141 and the stochastic codebook 144, respectively, from which a pitch vector and a pulse train are output.

In this case, the pulse train output from the stochastic codebook 144 is filtered through the pulse shaping section 162 with the filter coefficient thereof set by the pulse shaping filter analyzer section 161 based on the pitch vector determined by the search of the adaptive codebook 141, and then given a periodicity of the pitch period L by the pitch enhancement section 160 as required.

The pitch vector output from the adaptive codebook 141 and the pulse train output from the stochastic codebook 144 and modified by the pulse shaping section 162 and the pitch enhancement section 160 are multiplied by the gain G0 for the pitch vector and by the gain G1 for the noise vector at the gain multiplier sections 102, 103, respectively. The resulting signals are added to each other, input to the synthesis section 120 as an excitation signal, and from the synthesis section 120, output as a synthesized decoded speech signal. The gains G0, G1 are selected from the gain codebook not shown according to the index G.

In this way, according to this embodiment, the pulse shaping section 162 is used. Even in the case where an algebraic codebook with a reduced number of pulses due to the low rate encoding is used as the stochastic codebook 144, therefore, only the bit rate can be effectively reduced while maintaining the sound quality of the decoded speech.

Figure 8:
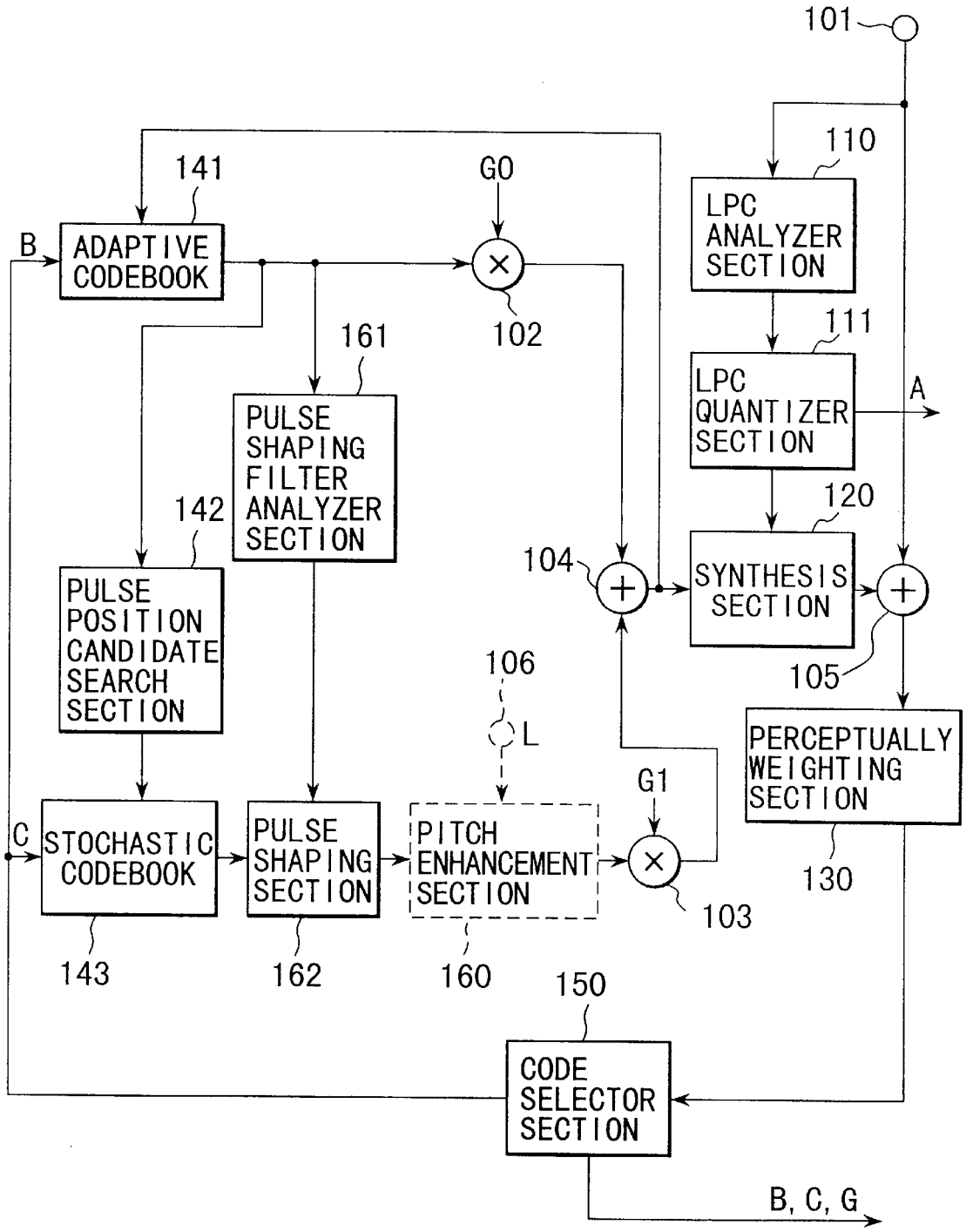
FIG. 8 is a block diagram showing a speech encoding system according to a third embodiment of the invention.

FIG. 8 shows a speech encoding system according to a third embodiment of the invention. This speech encoding system has such a configuration that the pulse shaping filter analyzer section 161 and the pulse shaping section 162 described with reference to the second embodiment are added to the configuration of the first embodiment.

Now, the steps of processing according to this embodiment will be explained. Like in the first embodiment, the first step to be executed is the LPC analysis and the LPC quantization. After complete search of the adaptive codebook 141, a pitch vector is delivered to the pulse position candidate search section 142 and the pulse shaping filter analyzer section 161. The pulse position candidate search section 142 determines pulse position candidates by the method described with reference to the first embodiment and produces an adaptive algebraic codebook 143. The pulse shaping filter analyzer section 161 determines the parameters of the pulse shaping section 162 as described with reference to the second embodiment. The parameters are normally the filter coefficients and the pulse shaping section normally consists of a digital filter.

In the search of the adaptive algebraic codebook 143, the pulse train output is shaped by the pulse shaping section 162. In actual search, the impulse response of the pulse shaping section 162 and the pitch enhancement section 160 is combined with the synthesis section 120, and therefore the calculation amount is reduced.

Figure 9:
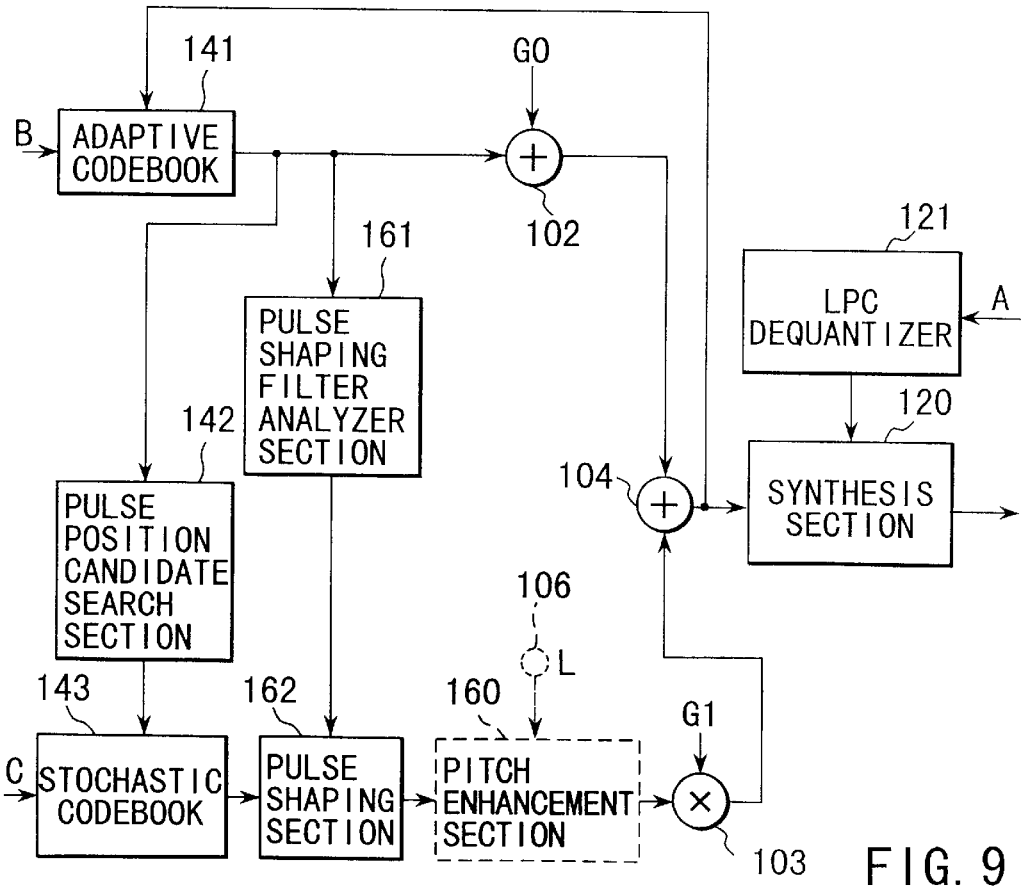
FIG. 9 is a block diagram showing a speech decoding system according to the third embodiment.

FIG. 9 shows a speech decoding-system corresponding to the speech encoding system of FIG. 8. The operation of this speech decoding system is obvious from the operation of the speech decoding system described with reference to the first and second embodiments. Therefore, the same component parts as the corresponding ones in FIGS. 1, 7 and 8 are designated by the same reference numerals, respectively, and will not be described in detail.

As described above, this embodiment uses the pulse position candidate search section 142 and the adaptive algebraic codebook 143 described with reference to the first embodiment and the pulse shaping filter analyzer section 161 and the pulse shaping section 152 described with reference to the second embodiment at the same time. Even in the case where a few number of pulses are selected from the limited position candidates, therefore, a high sound quality can be maintained, and a speech encoding system of high sound quality and low bit rate can be realized.

Figure 10:
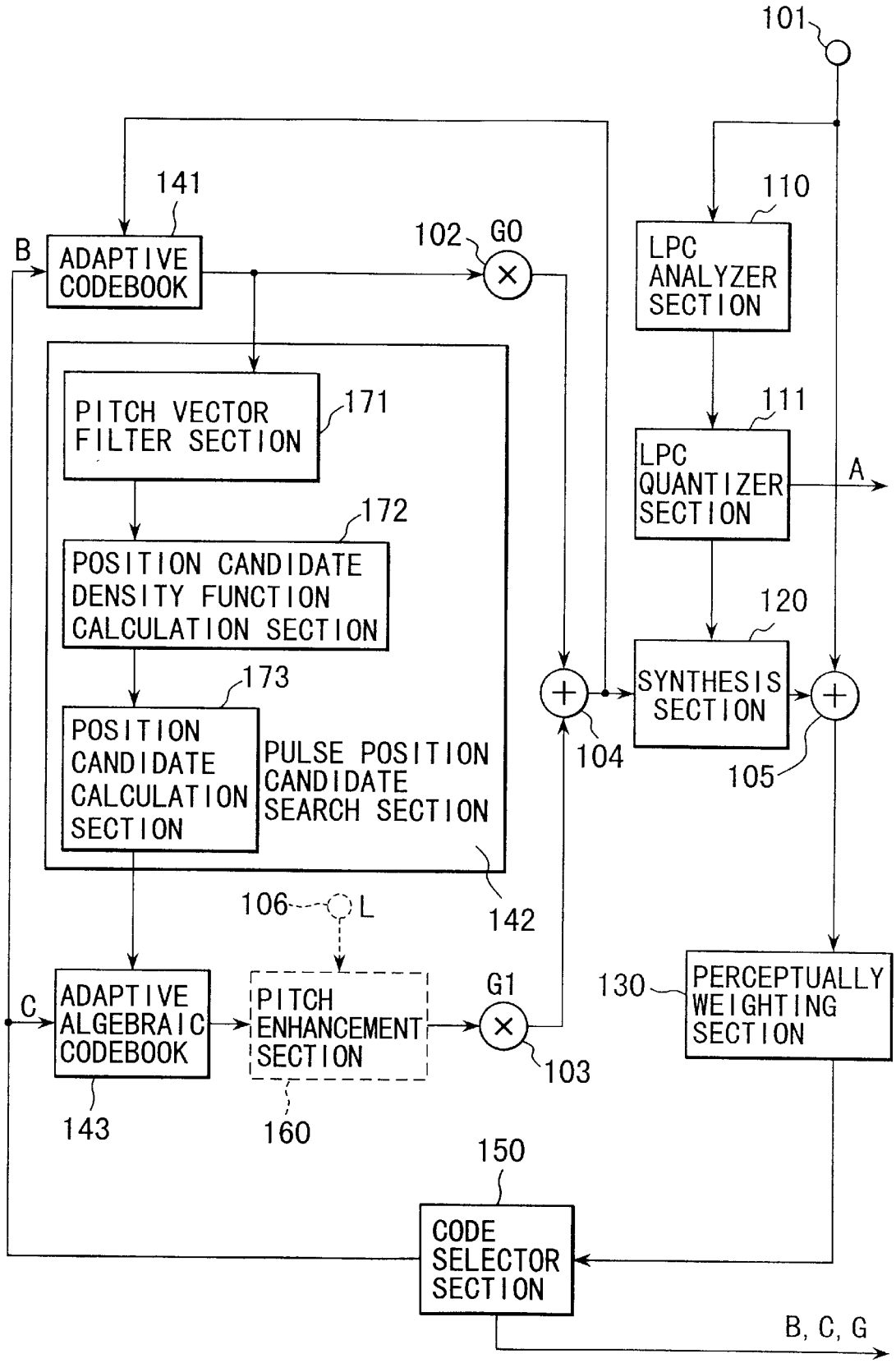
FIG. 10 is a block diagram showing a speech encoding system according to a fourth embodiment of the invention.

FIG. 10 shows a block diagram of a speech encoding system according to a fourth embodiment of the invention. This speech encoding system has the same configuration as the system of the first embodiment except that the pulse position candidate search section in the first embodiment includes a pitch vector smoothing section 171, a position candidate density function calculation section 172 and a position candidate calculation section 173.

The processing steps of this embodiment will be explained. As in the first embodiment, the first step is the LPC analysis and the LPC quantization. Upon complete search of the adaptive codebook 141, the pitch vector is delivered to the pitch vector smoothing section 171 of the pulse position candidate search section 142. The pitch vector smoothing section 171 subjects the pitch vector to the processing of steps S1 to S2 in the flowchart of FIG. 2, for example, and determines and outputs a power envelope of the pitch vector. In the position candidate density function calculation section 172, the power envelope is output by being converted into the position candidate density function. The position candidate calculation section 173 calculates pulse position candidates using this position candidate density function instead of the power envelope, and according to the pulse position candidates thus obtained, produces an adaptive algebraic codebook 143. Subsequent process is the same as that of the first embodiment.

Figure 11A:
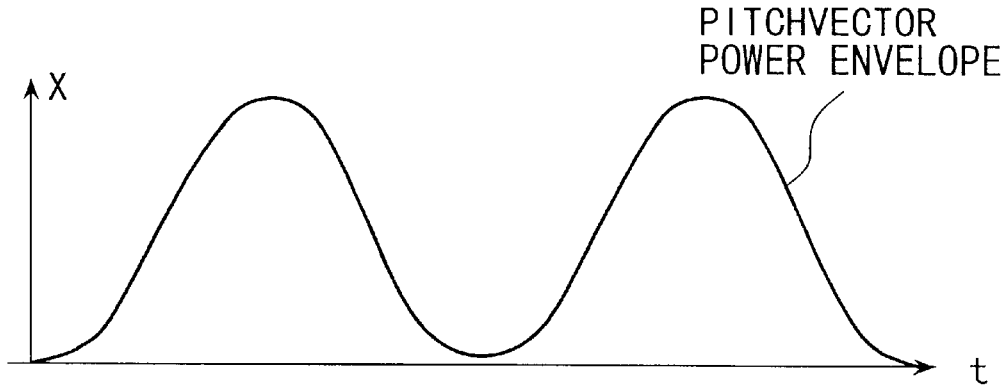
FIGS. 11A to 11C are diagrams representing the power envelope of the pitch vector and the position candidate density function and the position candidate density function.
Figure 11B:
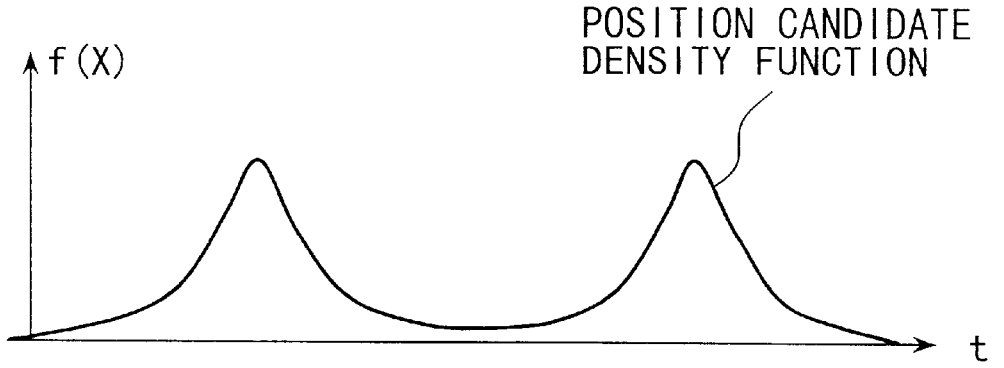
Figure 11C:
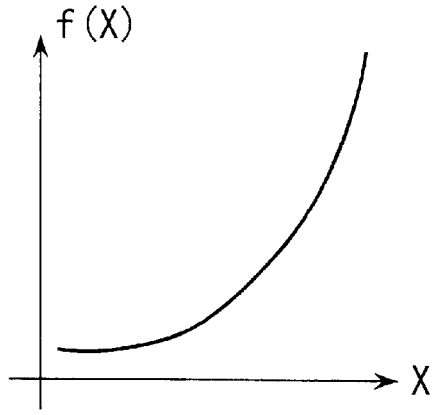

The feature of this embodiment lies in the method of processing in the pulse position candidate search section 142. According to the first embodiment, the power envelope of the pitch vector is used directly for adaptation of the pulse position candidates. In the present embodiment, in contrast, the power envelope is used for adaptation after being converted into the position candidate density function. This will be explained in detail with reference to FIGS. 11A to 11C. FIG. 11A shows the power envelope of the pitch vector output from the pitch vector smoothing section 171. In the position candidate density function calculation section 172, the position candidate density function (FIG. 11B) is generated from the power envelope of the pitch vector (FIG. 11A). In the process, the conversion is effected using a function f indicating the correspondence between the value (x) of the power envelope and the value f(x) of the position candidate density function shown in FIG. 11C. An example method of generating the function f is by determining it in advance statistically by processing a great number of learned speeches. Also, the table data can be used instead of the function.

The same pulse position candidate search section 142 including the function f for conversion is provided for the encoder and the decoder. Therefore, there is no need of sending information on the adaptation, and the bit rate is not increased as compared with the case in which no adaptation is performed.

Figure 12:
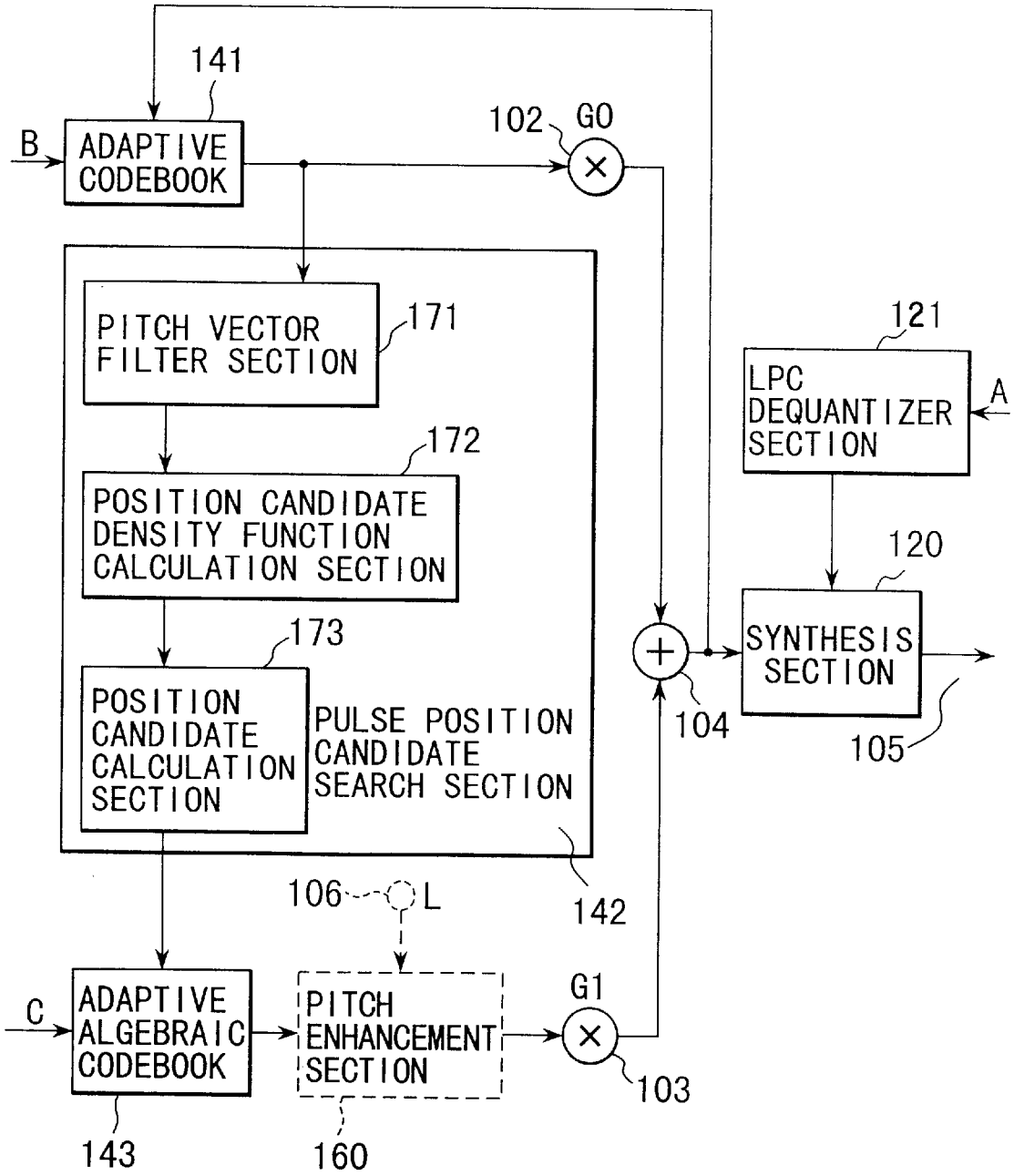
FIG. 12 is a block diagram showing a speech decoding system according to the fourth embodiment.

FIG. 12 shows a configuration of a speech encoding system according to this embodiment corresponding to the speech encoding system of FIG. 10. The operation of this speech encoding system is obvious from the operation of the speech encoding system explained in the first to third embodiments, and will not be explained in detail.

As described above, according to this embodiment, the value of the power envelope of the pitch vector and the density of the pulse position candidates are converted using the function f, and therefore the processing steps become somewhat complicated as compared with the first embodiment. Nevertheless, the position candidates can be distributed more accurately. Also, the first embodiment can be regarded as the same case as the one in which x=f(x) in this embodiment.

Figure 13:
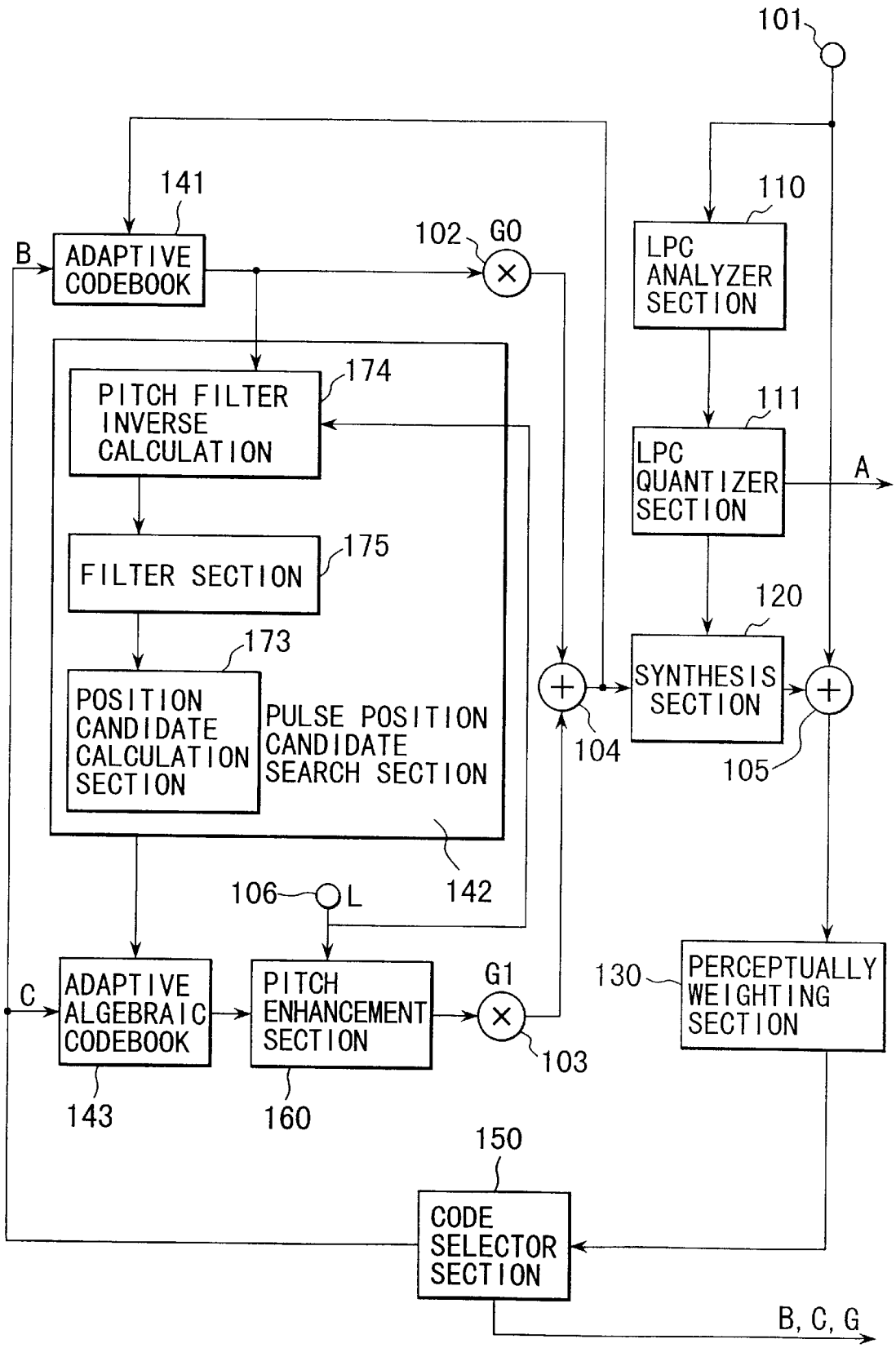
FIG. 13 is a block diagram showing a speech encoding system according to a fifth embodiment of the invention.

FIG. 13 shows a block diagram of a speech encoding system according to a fifth embodiment of the invention. This speech encoding system has the same configuration as the first embodiment except that the pulse position candidate search section of the first embodiment includes the pitch filter inverse calculation section 174, the smoothing section 175 and the position candidate calculation section 173.

Now, the processing steps of this embodiment will be explained. As in the first embodiment, the first step is the LPC analysis and the LPC quantization. After complete search of the adaptive codebook 141, the pitch vector is delivered to the pitch filter inverse calculation section 174 of the pulse position candidate search section 142. The pitch filter inverse calculation section 174 makes a calculation for expressing the inverse characteristic of the pitch enhancement section 160. Assume, for example, that the transfer function P(z) of the pitch filter is given as $$P(z)=1-a\ z^{(-L)} \tag{1}$$

The pitch filter inverse calculation section 174 can use a filter with the transfer function Q(z) given as $$Q(z)=1/(1-b\ a\ z^{(-L)}) \tag{2}$$

where a is a constant, b the degree of inverse characteristic, and when b=1, Q(z) becomes an inverse filter of P(z). The input pitch vector is output after being inversely calculated, and the smoothing section 175 determines the power envelope in the same manner as the pitch vector smoothing section 171 of the fourth embodiment. In the position candidate calculation section 173, the pulse position candidates are selected according to this power envelope and the adaptive algebraic codebook 143 is produced. Subsequent processes are similar to those of the first embodiment.

The feature of this embodiment lies in that the pitch vector taking the effect of the pitch enhancement section 160 into account is used for adaptation of the pulse position candidates. By doing so, the efficiency is improved for the reason described below. The noise vector generated from the adaptive algebraic codebook is given a periodicity by the pitch enhancement section 160. In the case where equation 1 is used for giving a periodicity, the pulses in the neighborhood of the head of the subframe are repeated many times within the subframe at pitch period intervals, while the pulses in the last half nearer to the tail are repeated to lesser degree. Observation of the noise code vector actually obtained shows that the stronger the pitch filter used, the higher the tendency of the pulses nearer to the head to rise. This indicates that the pulse position depends not only on the shape of the pitch vector but also on the pitch filter. According to this embodiment, the pitch filter inverse calculation section 174 is used to realize the adaptation of the pulse position candidates taking the effect of the pitch enhancement section 160 into consideration.

According to the third embodiment, the noise vector is applied through two different types of filters including a pulse shaping filter and a pitch filter. When applying the present embodiment in such a case, ideally, the characteristic of the two filters combined is determined, and the inverse characteristic of this characteristic is used for the pitch filter inverse calculation section. To avoid the increase in the processing amount, however, the use of only the characteristic of the pitch filter having a larger effect is also effective. Also, the pitch filter inverse calculation section 174 and the smoothing section 175 can be reversed in order.

Figure 14:
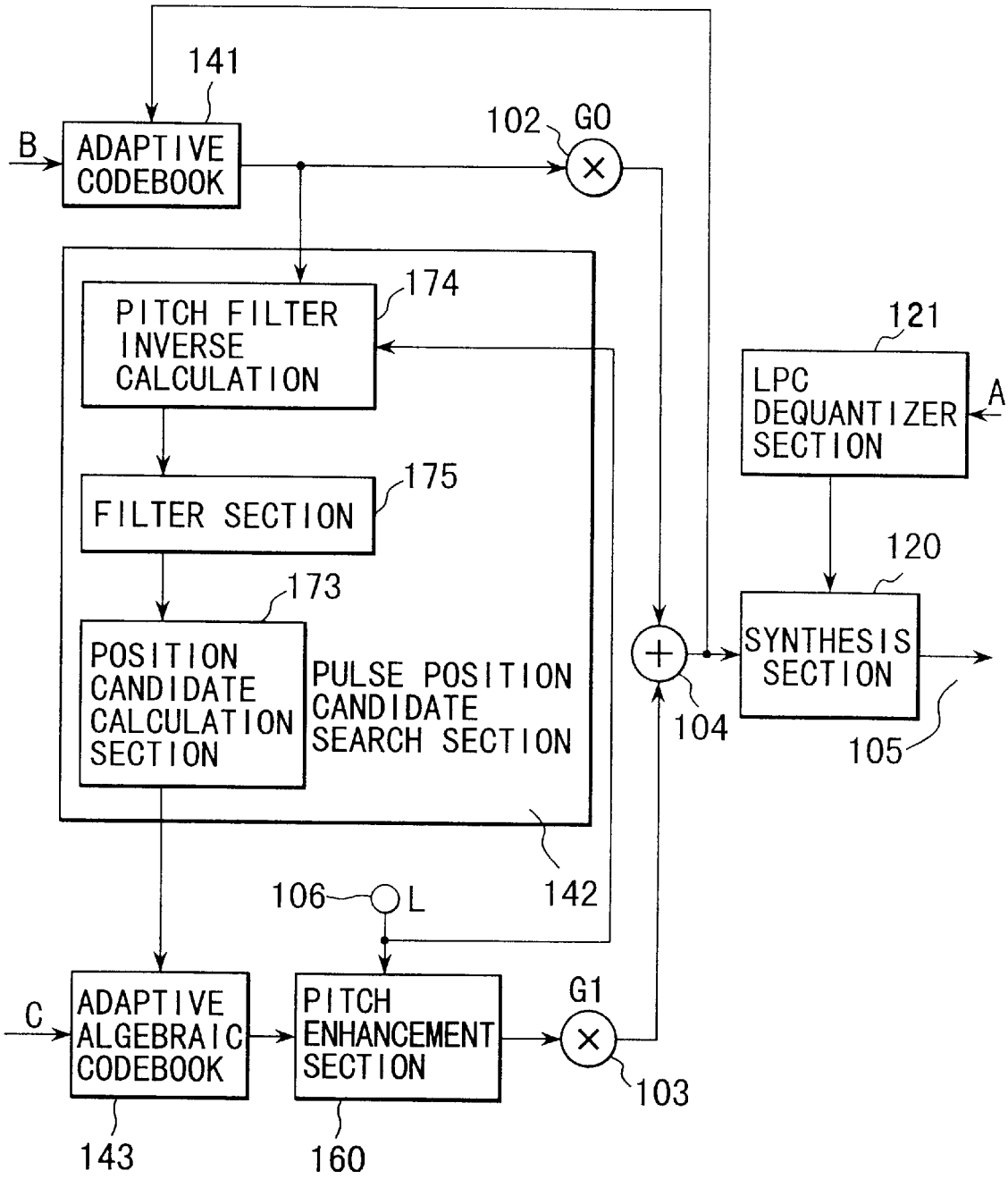
FIG. 14 is a block diagram showing a speech decoding system according to the fifth embodiment.

FIG. 14 shows a configuration of a speech decoding system according to this embodiment corresponding to the speech encoding system of FIG. 13. The operation of this speech encoding system is obvious from the operation of the speech decoding system described in the first to fourth embodiments and therefore will not be described in detail.

Figure 15:
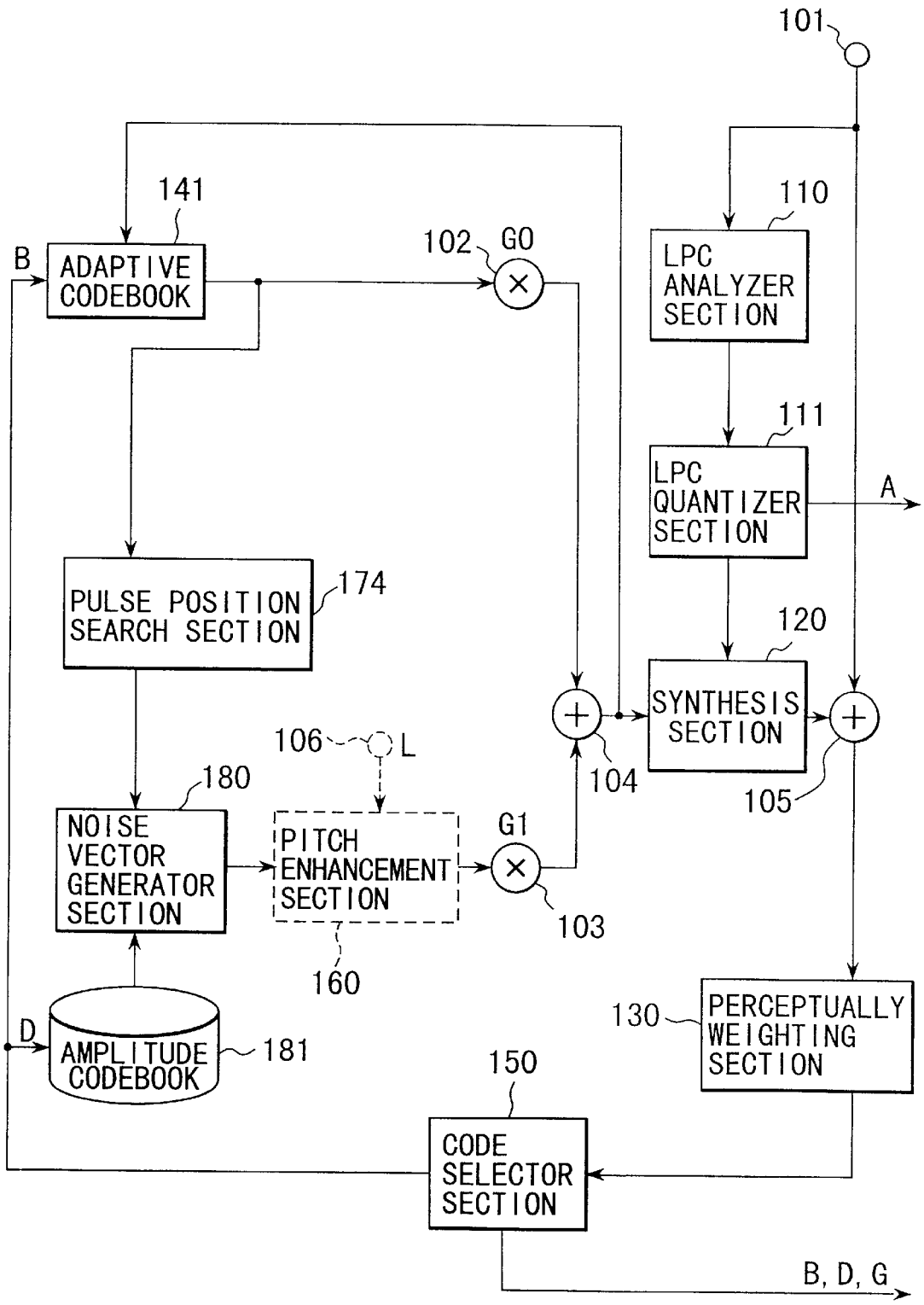
FIG. 15 is a block diagram showing a speech encoding system according to a sixth embodiment of the invention.

FIG. 15 is a block diagram showing a speech encoding system according to a sixth embodiment of the invention. The configuration of this speech encoding system is the same as that of the first embodiment except that the adaptive algebraic codebook according to the first embodiment is replaced by the noise vector generating section 180 and the amplitude codebook 181.

Now, the processing steps according to this embodiment will be explained. Like in the first embodiment, the first step is the LPC analysis and the LPC quantization, and upon complete search of the adaptive codebook 141, the pitch vector is delivered to the pulse position search section 174. In the pulse position search section 174, the pulse positions are determined based on the power envelope of the pitch vector by the same method as in the first embodiment, and are output to the noise vector generating section. This embodiment is different from the foregoing embodiments in that pulses are set by the noise vector search section at all the positions determined by the pulse position search section 174. Specifically, in the foregoing embodiments, the pulse position candidates are determined and the optimum pulse positions are selected by the adaptive algebraic codebook. According to this embodiment, in contrast, all the pulse position candidates are used at the same time. Therefore, the processing for selecting the pulse positions is eliminated. Instead, the processing is added for selecting the amplitude of each pulse from the amplitude codebook 181. Also, the information D representing the pulse amplitude is output in place of the information c indicating the pulse positions.

Figure 16:
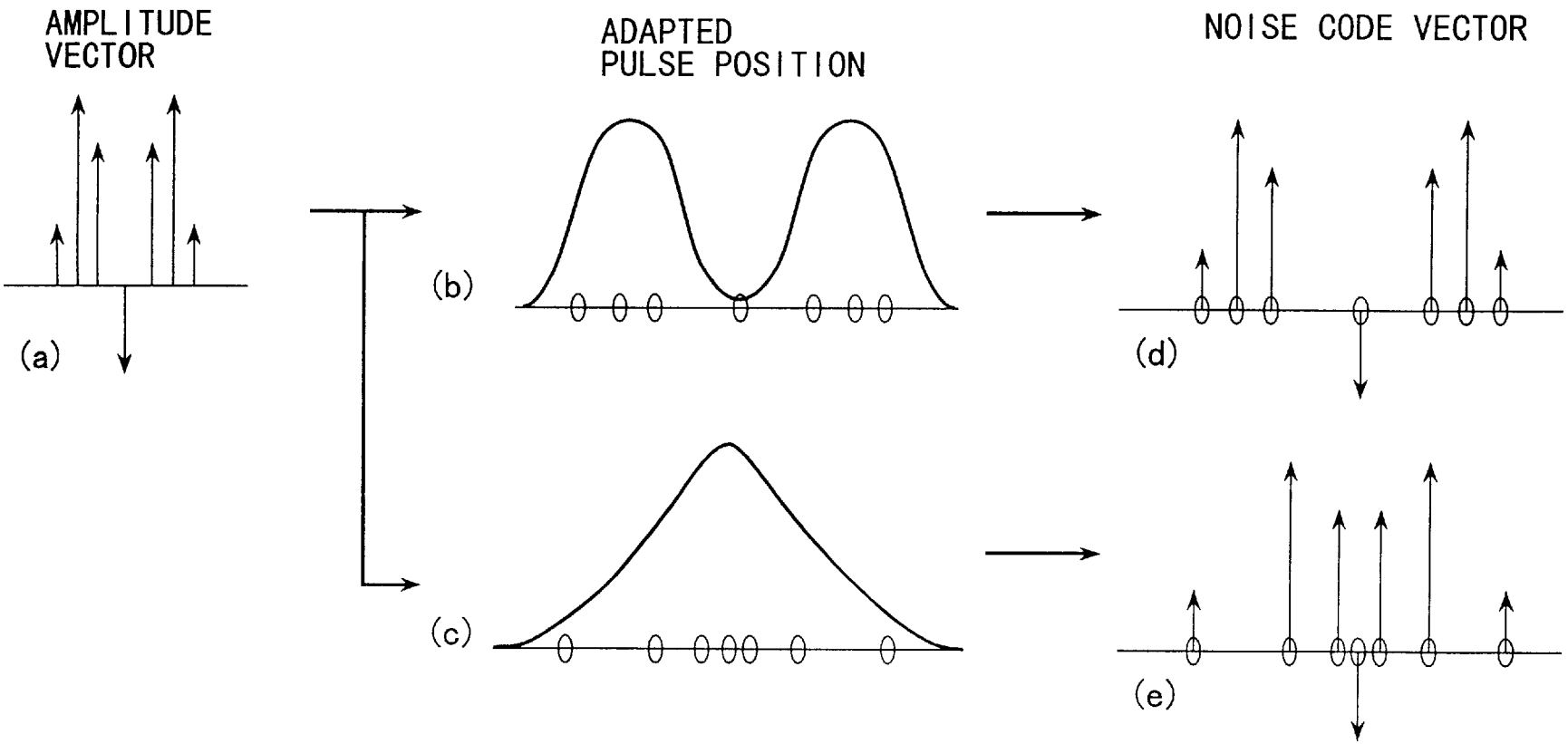
FIG. 16 is a diagrams for explaining how to form noise vectors.

A method of generating a noise vector will be described in detail with reference to FIG. 16. The amplitude pattern obtained from the amplitude codebook is shown by arrow in the graph (a) of FIG. 16. This case assumes that seven pulses are raised. The waveforms (b) and (c) of FIG. 16 represent the pitch vector power envelope obtained at the pulse position search section 174 and the corresponding pulse positions (indicated by circles in the diagram). In the waveform (b) of FIG. 16, the power has two high portions so that seven pulse positions are distributed to two positions. In the waveform (c) of FIG. 16, in contrast, only one high portion exists at the center, at which the pulse positions are concentrated. The graphs (d) and (e) of FIG. 16 show noise vectors obtained by setting the amplitude pulses (a) of FIG. 16 at the respective pulse positions. It is seen that the shape of the excitation signal changes with the pitch vector power envelope. As already described, the information on the power envelope of the pitch vector is not required to be transmitted. According to this embodiment, therefore, the noise vector can be formed in an almost ideal shape without increasing the bit rate.

In this embodiment, the higher the bit rate, the more pulse amplitude information D can be sent with an increasingly improved quality. Nevertheless, the degree of improvement progressively decreases. With a certain high bit rate, the performance may be improved more by including the noise vectors in the search candidates with pulses set at positions not selected than by increasing the amplitude information. Specifically, the pulse position search section 174 outputs different pulse position patterns (pulse patterns), and the noise vector generating section searches the amplitude for each pulse pattern. A pulse pattern generated from the pulse positions not selected is produced in addition to the above-mentioned pulse pattern adapted to the pitch vector. A method can be cited, for example, in which all the sample positions of the subframe less the sample positions selected by adaptation are used as a second pulse pattern, so that the amplitude search is carried out for the two pulse patterns. The number of bits allocated to the amplitude information can be varied from one pulse pattern to another. Normally, however, it is more efficient to allocate more bits to the pulse pattern that has used the adaptation. In the case of using a plurality of pulse patterns, it is necessary to include in the information D the information as to which pulse pattern is used. The amplitude information correspondingly decreases. However, the quality is higher than when searching only one pulse pattern.

Figure 17:
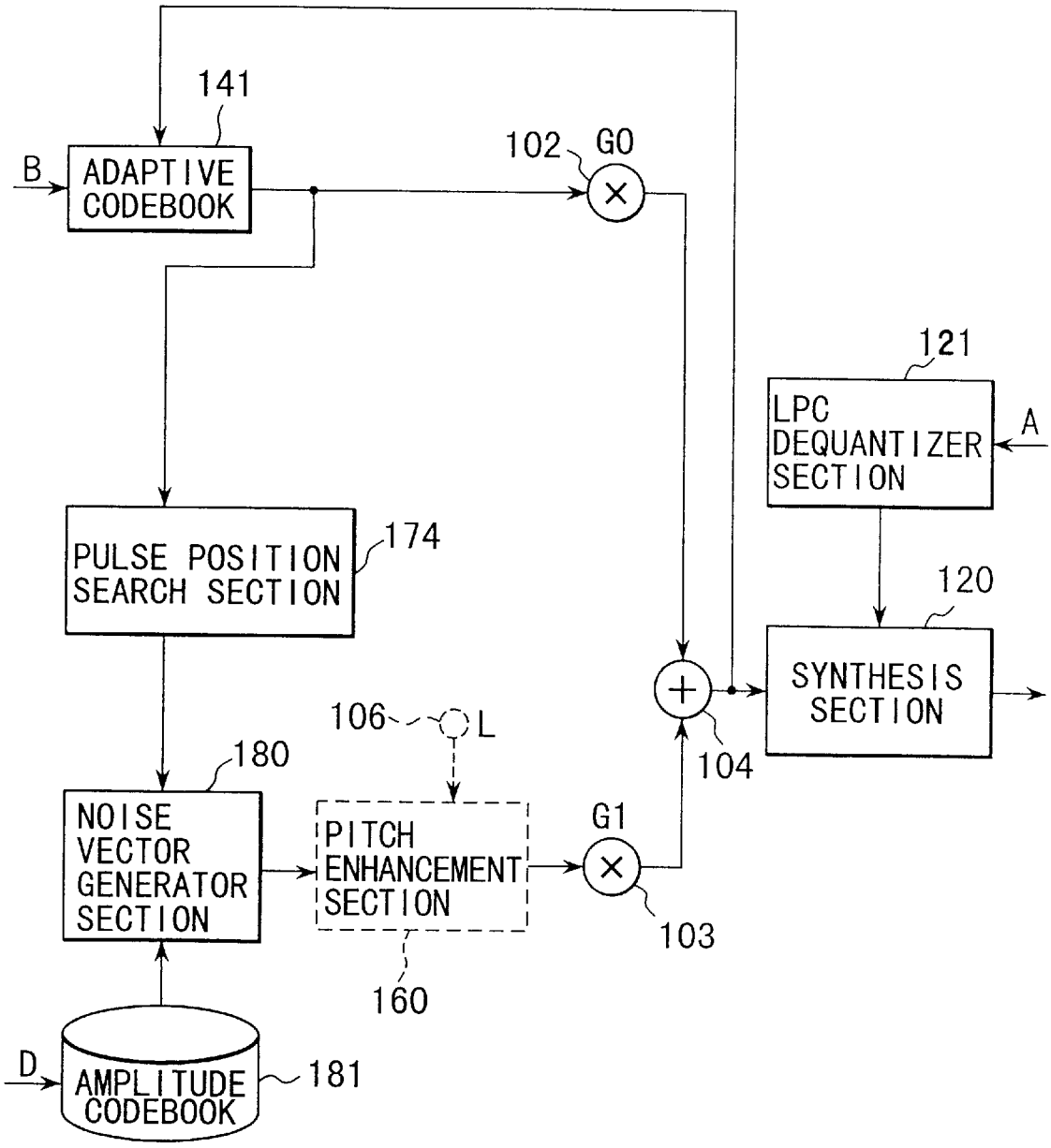
FIG. 17 is a block diagram showing a speech decoding system according to the sixth embodiment.

FIG. 17 shows a configuration of a speech decoding system according to this embodiment corresponding to the speech encoding system of FIG. 15. The operation of this speech decoding system is obvious from the operation of the speech decoding system described in the first to fifth embodiments, and therefore will not be described in detail.

Although a speech encoding/decoding method is described above with reference to embodiments, the present invention is also applicable to a speech synthesis method. In such a case, in the speech decoding system shown in FIGS. 5, 7 and 9, each index is determined based on a reconstructed speech signal to be synthesized.

It will thus be understood from the foregoing description that according to this invention, a speech encoding/decoding operation of high sound quality can be performed even when using a pulse codebook with a decreased number of pulse positions and pulses due to the low rate encoding.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech encoding method comprising:

generating information representing characteristics of a synthesis filter based on an input speech signal in units of one frame;

generating a pitch vector from an adaptive codebook containing a plurality of past excitation signals;

generating a first number of reduced pulse position candidates by selecting a first number of pulse positions from a number of possible pulse positions in each of sub-frames obtained by dividing the frame, a density of the reduced pulse position candidates being changed in accordance with a shape of the pitch vector; and selecting a second number of pulse positions from the reduced pulse position candidates to generate a pulse train having a plurality of pulses located at a plurality of pulse positions corresponding to a second number of pulse positions under the criterion of minimizing an error between the input speech signal and a synthesis signal which is an output of the synthesis filter whose input is an excitation signal generated by adding the pitch vector and the pulse train.

2. A speech encoding method according to claim 1, which includes giving a periodicity in units of pitches.

3. A speech encoding method according to claim 1, wherein the pulse position candidates are obtained in a sample direction and a first number of pulse position candidates is less than a length of the sub-frame.

4. A speech encoding method comprising:

generating information representing characteristics of a synthesis filter based on an input speech signal in units of one frame;

generating a pitch vector from an adaptive codebook containing past excitation signals;

generating a first number of reduced pulse position candidates by selecting a first number of pulse positions from a number of possible pulse positions in each of sub-frames obtained by dividing the frame, a density of the reduced pulse position candidates being high where the pitch vector has a large power and decreasing in accordance with a decrease in the power; and selecting a second number of pulse positions from the reduced pulse position candidates to generate a pulse train having a plurality of pulses located at a plurality of pulse positions corresponding to a second number of pulse positions under the criterion of minimizing an error between the input speech signal and a synthesis signal which is an output of the synthesis filter whose input is an excitation signal generated by adding the pitch vector and the pulse train.

5. A speech encoding method according to claim 4, which includes giving a periodicity in units of pitches.

6. A speech encoding method according to claim 4, wherein the pulse position candidates are obtained in a sample direction and a first number of pulse position candidates is less than a length of the sub-frame.

7. A speech encoding method comprising:

generating information representing characteristics of a synthesis filter based on an input speech signal in units of one frame;

generating a pitch vector from an adaptive codebook containing a plurality of past excitation signals;

generating a first number of reduced pulse position candidates by selecting a first number of pulse positions from a number of possible pulse positions in each of sub-frames obtained by dividing the frame, a density of the reduced pulse position candidates being changed in accordance with a shape of an inverse compensation pitch vector obtained by subjecting the pitch vector to a computation based on inverse characteristics of a compensation filter; and selecting a second number of pulse positions from the reduced pulse position candidates to generate a pulse train having a plurality of pulses located at a plurality of pulse positions corresponding to a second number of pulse positions under the criterion of minimizing an error between the input speech signal and a synthesis signal which is an output of the synthesis filter whose input is an excitation signal generated by adding the pitch vector and a compensated pulse train obtained by subjecting the pulse train to the compensation filter.

8. A speech encoding method according to claim 7, wherein the pulse position candidates are obtained in a sample direction and distributed densely at position of larger power of the pitch vector.

9. A speech decoding method comprising:

receiving an encoded bit stream containing indices relative to a synthesis filter in units of one frame, and a pitch vector and a pulse train in units of one sub-frame;

generating the synthesis filter and the pitch vector depending on the indices;

generating a first number of reduced pulse position candidates by selecting a first number of pulse positions from a number of possible pulse positions in the sub-frame, a density of the reduced pulse position candidates being changed in accordance with a shape of the pitch vector;

generating a second number of pulse positions from the first number of reduced pulse position candidates based on the indices;

generating a pulse train having a plurality of pulses located at a plurality of pulse positions corresponding to the second number of pulse positions;

generating an excitation signal including the pitch vector and the pulse train; and inputting the excitation signal to a synthesis filter for reconstructing a speech signal.

10. A speech decoding method comprising:

receiving an encoded bit stream containing indices relative to a synthesis filter in units of one frame, and a pitch vector and a pulse train in units of one sub-frame;

generating the synthesis filter and the pitch vector depending on the indices;

generating a first number of reduced pulse position candidates by selecting a first number of pulse positions from a number of possible pulse positions in the sub-frame, a density of the reduced pulse position candidates being high where the pitch vector has a large power and decreasing in accordance with a decrease in power;

generating a second number of pulse positions from the first number of reduced pulse position candidates based on the indices;

generating a pulse train having a plurality of pulses located at a plurality of pulse positions corresponding to the second number of pulse positions;

generating an excitation signal including the pitch vector and the pulse train; and inputting the excitation signal to a synthesis filter for reconstructing a speech signal.

11. A speech decoding method comprising:

receiving an encoded bit stream containing indices relative to a synthesis filter in units of one frame, and a pitch vector and a pulse train in units of one sub-frame;

generating the synthesis filter and the pitch vector depending on the indices;

generating a first number of reduced pulse position candidates by selecting a first number of pulse positions from a number of possible pulse positions in the sub-frame, a density of the reduced pulse position candidates being changed in accordance with a shape of an inverse compensation pitch vector obtained by subjecting the pitch vector to a computation based on inverse characteristics of a compensation filter;

generating a second number of pulse positions from the first number of reduced pulse position candidates based on the indices;

generating a pulse train having a plurality of pulses located at a plurality of pulse positions corresponding to the second number of pulse positions;

generating an excitation signal including the pitch vector and a compensated pulse train obtained by subjecting the pulse train to a compensation filter; and inputting the excitation signal to a synthesis filter for reconstructing a speech signal.

12. A speech encoding apparatus comprising:

a first generator configured to generate information representing characteristics of a synthesis filter based on an input speech signal in units of one frame;

a second generator configured to generate a pitch vector from an adaptive codebook containing a plurality of past excitation signals;

a third generator configured to generate a first number of reduced pulse position candidates by selecting a first number of pulse positions from a number of possible pulse positions in the sub-frame, a density of the reduced pulse position candidates being changed in accordance with a shape of the pitch vector; and a selector configured to select a second number of pulse positions from the reduced pulse position candidates to generate a pulse train having a plurality of pulses located at a plurality of pulse positions corresponding to a second number of pulse positions under the criterion of minimizing an error between the input speech signal and a synthesis signal which is an output of the synthesis filter whose input is an excitation signal generated by adding the pitch vector and the pulse train.

13. A speech encoding apparatus according to claim 12, wherein the pulse position candidates are obtained in a sample direction and a first number of pulse position candidates is less than a length of the sub-frame.

14. A speech encoding apparatus comprising:

a first generator configured to generate information representing characteristics of a synthesis filter based on an input speech signal in units of one frame;

a second generator configured to generate a pitch vector from an adaptive codebook containing a plurality of past excitation signals;

a third generator configured to generate a first number of reduced pulse position candidates by selecting a first number of pulse positions from a number of possible pulse positions in the sub-frame, a density of the reduced pulse position candidates being high where the pitch vector has a large power and decreasing in accordance with a decrease in the power; and a selector configured to select a second number of pulse positions from the reduced pulse position candidates to generate a pulse train having a plurality of pulses located at a plurality of pulse positions corresponding to a second number of pulse positions under the criterion of minimizing an error between the input speech signal and a synthesis signal which is an output of the synthesis filter whose input is an excitation signal generated by adding the pitch vector and the pulse train.

15. A speech encoding apparatus according to claim 14, wherein the pulse position candidates are obtained in a sample direction and a first number of pulse position candidates is less than a length of the sub-frame.

16. A speech encoding apparatus comprising:

a first generator configured to generate information representing characteristics of a synthesis filter based on an input speech signal in units of one frame;

a second generator configured to generate a pitch vector from an adaptive codebook containing a plurality of past excitation signals;

a third generator configured to generate a first number of reduced pulse position candidates by selecting a first number of pulse positions from a number of possible pulse positions in the sub-frame, a density of the reduced pulse position candidates being changed in accordance with a shape of an inverse compensation pitch vector obtained by subjecting the pitch vector to a computation based on inverse characteristics of the compensation filter; and a selector configured to select a second number of pulse positions from the reduced pulse position candidates to generate a pulse train having a plurality of pulses located at a plurality of pulse positions corresponding to a second number of pulse positions under the criterion of minimizing an error between the input speech signal and a synthesis signal which is an output of the synthesis filter whose input is an excitation signal generated by adding the pitch vector and a compensated pulse train obtained by subjecting the pulse train to the compensation filter.

17. A speech encoding apparatus according to claim 16, wherein the pulse position candidates are obtained in a sample direction and located densely at positions of larger power of the pitch vector.

18. A speech decoding apparatus comprising:

a receiver configured to receive an encoded bit stream containing indices relative to a synthesis filter in units of one frame, and a pitch vector and a pulse train in units of one sub-frame;

a first generator configured to generate the synthesis filter and the pitch vector depending on the indices;

a second generator configured to generate a first number of reduced pulse position candidates by selecting a first number of pulse positions from a number of possible pulse positions in the sub-frame, a density of the reduced pulse position candidates being changed in accordance with a shape of the pitch vector;

a third generator configured to generate a second number of pulse positions from the first number of reduced pulse position candidates based on the indices;

a fourth generator configured to generate a pulse train having plurality of pulses located at a plurality of pulse positions corresponding to the second number of pulse positions;

a fifth generator configured to generate an excitation signal including the pitch vector and the pulse train; and an input device configured to input the excitation signal to a synthesis filter for reconstructing a speech signal.

19. A speech decoding apparatus comprising:

a receiver configured to receive an encoded bit stream containing indices relative to a synthesis filter in units of one frame, and a pitch vector and a pulse train in units of one sub-frame;

a first generator configured to generate the synthesis filter and the pitch vector depending on the indices;

a second generator configured to generate a first number of reduced pulse position candidates by selecting a first number of pulse positions from a number of possible pulse positions in the sub-frame, a density of the reduced pulse position candidates being high where the pitch vector has a large power and decreasing in accordance with a decrease in a power;

a third generator configured to generate a second number of pulse positions from the first number of reduced pulse position candidates based on the indices;

a fourth generator configured to generate a pulse train having a plurality of pulses located at a plurality of pulse positions corresponding to the second number of pulse positions;

a fifth generator configured to generate an excitation signal including the pitch vector and the pulse train; and an input device configured to input the excitation signal to a synthesis filter for reconstructing a speech signal.

20. A speech decoding apparatus comprising:

a receiver configured to receive an encoded bit stream containing indices relative to a synthesis filter in units of one frame, and a pitch vector and a pulse train in units of one sub-frame;

a first generator configured to generate the synthesis filter and the pitch vector depending on the indices;

a second generator configured to generate a first number of reduced pulse position candidates by selecting a first number of pulse positions from a number of possible pulse positions in the sub-frame, a density of the reduced pulse position candidates being changed in accordance with a shape of an inverse compensation pitch vector obtained by subjecting the pitch vector to a computation based on inverse characteristics of a compensation filter;

a third generator configured to generate a second number of pulse positions from the first number of reduced pulse position candidates based on the indices;

a fourth generator configured to generate a pulse train having a plurality of pulses located at a plurality of pulse positions corresponding to the second number of pulse positions; and a fifth generator configured to generate an excitation signal including the pitch vector and a compensated pulse train obtained by subjecting the pulse train to a compensation filter and an input device configured to input the excitation signal to a synthesis filter for reconstructing a speech signal.

* * * * *